United States Patent [19]

Bodnick et al.

[11] 4,203,828

[45] May 20, 1980

[54] HYDRODESULFURIZATION PROCESS

[75] Inventors: Sheldon Bodnick, Rockaway, N.J.; John C. Brice, Epsom, England

[73] Assignee: Exxon Research & Engineering Co., Florham Park, N.J.

[21] Appl. No.: 690,254

[22] Filed: May 26, 1976

[51] Int. Cl.[2] ..... C10G 23/02

[52] U.S. Cl. .....208/213; 208/216R

[58] Field of Search ..... 208/213, 216, 209, 211

[56] References Cited

U.S. PATENT DOCUMENTS

| | | | |
|---|---|---|---|
| 2,912,375 | 11/1959 | MacLaren | 208/213 |
| 3,475,324 | 10/1969 | Borst, Jr. | 208/213 |
| 3,501,396 | 3/1970 | Gatsis | 208/216 |
| 3,753,894 | 8/1973 | Shoemaker et al. | 208/216 |
| 3,767,569 | 10/1973 | Mayer et al. | 208/211 |
| 3,976,562 | 8/1976 | Eberly, Jr. | 208/216 |

*Primary Examiner*—George Crasanakis

*Attorney, Agent, or Firm*—Marthe L. Gibbons

[57] ABSTRACT

In the hydrodesulfurization of sulfur-containing heavy hydrocarbon oils, water is injected into the hydrotreating gas and vaporized at a temperature below 450° F. to produce a steam-containing hydrotreating gas which is combined subsequently with the sulfur-containing heavy hydrocarbon oil.

7 Claims, 1 Drawing Figure

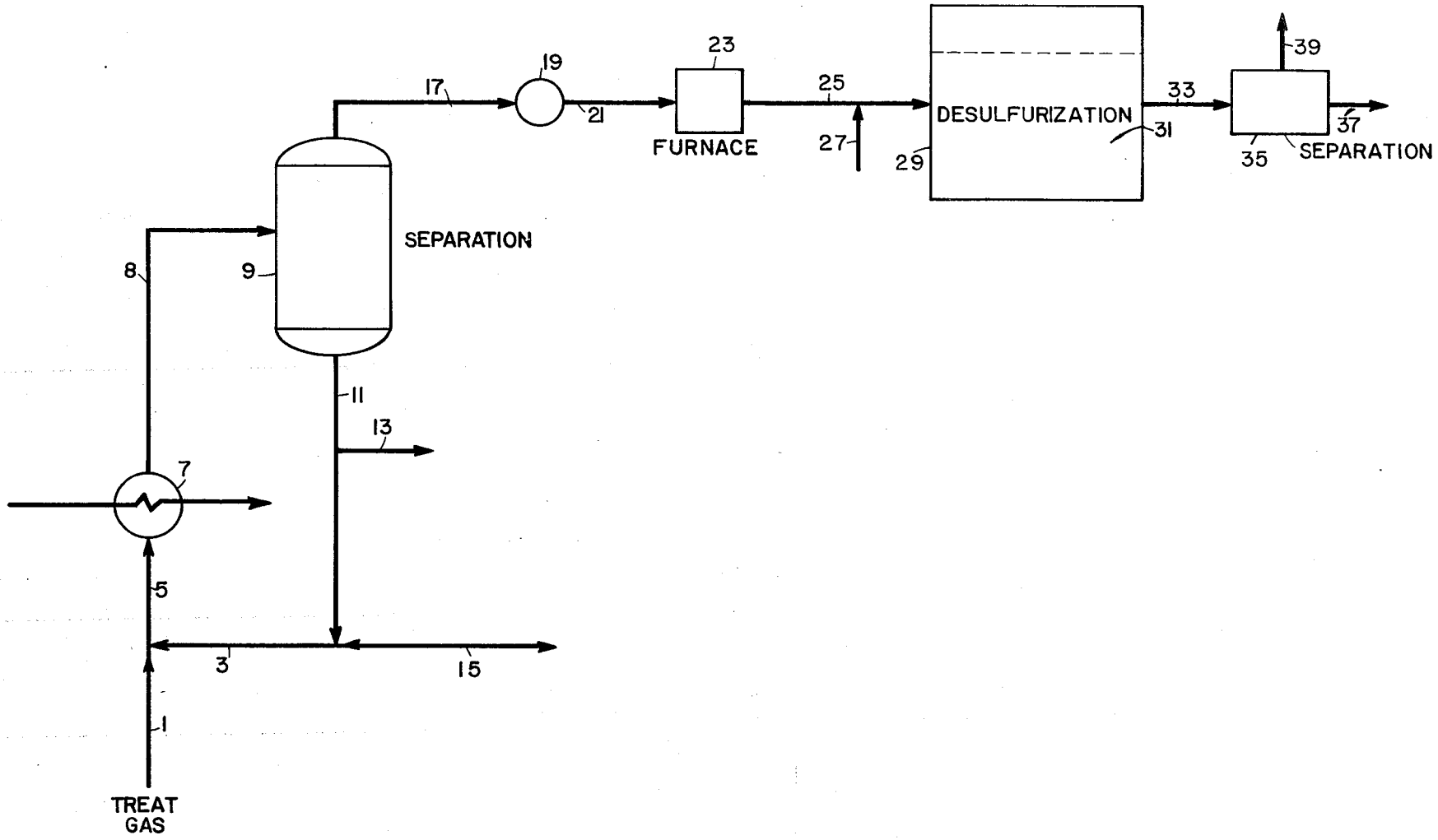
TREAT GAS
1
3
5
7
8
9
SEPARATION
11
13
15
17
19
21
23
FURNACE
25
27
29
DESULFURIZATION
31
33
35
SEPARATION
37
39

HYDRODESULFURIZATION PROCESS

BACKGROUND OF THE INVENTION

1. Field of the Invention

The present invention relates to a process for the desulfurization of sulfur-containing hydrocarbon oils. More particularly, it relates to a hydrodesulfurization process wherein a sulfur-containing heavy hydrocarbon oil is treated with hydrogen and steam in the presence of a hydrodesulfurization catalyst.

2. Description of the Prior Art

Hydrodesulfurization processes in which heavy petroleum distillates or residual fractions are treated with hydrogen in the presence of a catalyst comprising a hydrogenation component composited with a refractory support are well known (see, for example, U.S. Pat. Nos. 3,531,398 and 3,509,044). It is also known to mix a hydrocarbon oil with from 2 to 30 percent by weight of water and to react the resulting mixture in contact with the catalyst under hydrodesulfurization conditions (see, for example, U.S. Pat. No. 3,501,396). A disadvantage of such a prior art procedure of injecting the water into the oil feed and vaporizing it or, alternatively, generating steam at the desulfurization unit operating pressure is that the vapor pressure of the steam will approach the desulfurization unit operating pressure and that additional heat of vaporization must be supplied at temperatures in the range of 500° to 700° F. At this temperature level, the heat absorbed by the water must be supplied by a furnace, thus incurring high investments of equipment. In addition, there is a substantial recurring fuel cost for supplying the heat of vaporization.

U.S. Pat. No. 2,606,141 discloses that water or water vapor may be injected into a hydrogen recycle gas stream prior to mixing the gas stream with the hydrocarbon oil which is to be vaporized for subsequent desulfurization.

U.S. Pat. No. 3,719,588 teaches the addition of steam to a carbon monoxide-containing reactant gas utilized in a hydrodesulfurization process.

An improved method of generating the steam desired in the hydrodesulfurization stage has now been found.

SUMMARY OF THE INVENTION

In accordance with the invention, there is provided in a process for hydrodesulfurizing a sulfur-containing heavy hydrocarbon oil wherein said oil is contacted with hydrogen and steam in the presence of a hydrodesulfurization catalyst at hydrodesulfurization conditions including a temperature varying from about 400° F. to about 900° F. and a pressure varying from about 800 pounds per square inch gauge (psig) to about 3,000 psig, the improvement which comprises: (a) mixing a hydrogen-containing gas and water; (b) vaporizing at a temperature below about 450° F. at least a portion of said water to steam; (c) contacting the resulting steam and hydrogen-containing gas with a sulfur-containing heavy hydrocarbon oil in the presence of said hydrodesulfurization catalyst under said hydrodesulfurization conditions; and (d) recovering a hydrocarbon oil reduced in sulfur content.

With the water injection and steam generation method of the present invention, the need for a separate furnace to vaporize the water is eliminated. Furthermore, most of the heat required to vaporize the water is provided at low level so that the additional heat load to the oil or treat gas furnace is minimized.

BRIEF DESCRIPTION OF THE DRAWING

The FIGURE is a diagrammatic process flow plan of one embodiment of the invention.

DESCRIPTION OF THE PREFERRED EMBODIMENT

The preferred embodiment of the invention will be described with reference to the accompanying FIGURE. Referring to the FIGURE, a hydrogen-containing treat gas carried in line 1 is injected into a circulating water stream carried in line 3. The combined stream formed in line 5 is passed through indirect heat exchanger 7 by a thermosiphon effect where it is heated to a temperature below 450° F., preferably to a temperature ranging from about 300° to about 400° F. to vaporize a portion of the water therein and to produce a steam and hydrogen-containing treat gas. The vaporization of only a portion of the water avoids the possibility of the dry point in the heat exchanger which would result in the accumulation of solids contained in the water in the exchanger with consequent fouling of equipment. The resulting steam and hydrogen-containing treat gas will generally contain from about 5 to about 15 mole percent of steam. A typical steam partial pressure after vaporization would be about 150 pounds per square inch absolute (psia). Since the steam partial pressure is low, a source of heat below about 450° F. can be utilized, for example, waste heat available from the process. The steam and hydrogen-containing treat gas and unvaporized water are passed from heat exchanger 7 via line 8 to a separation zone such as a conventional separator 9 where gas is separated from unvaporized water. The latter is removed from the separator via line 11. If desired, a purge water stream may be removed via line 13. The separated water is then passed into line 3. Make-up water may be injected into line 3 via line 15. The steam and hydrogen-containing gas is removed overhead from separator 9 via line 17 passed through heat exchanger 19, removed by line 21, passed through furnace 23, removed from the furnace by line 25. A sulfur-containing heavy hydrocarbon oil feed is introduced by line 27 into the steam and hydrogen-containing treat gas carried in line 25. The combined oil and gas stream is then passed into a desulfurization zone 29 by line 25. Alternatively, the oil feed could be introduced into line 21 or the oil feed could be introduced separately into the desulfurization zone. The desulfurization zone may comprise one or more steps of desulfurization which may be in one or more vessels. For simplicity of description, only one desulfurization zone is shown in the drawing. Suitable sulfur-containing heavy hydrocarbon oil feed for treating in the desulfurization process of the present invention include feeds having up to about 8 weight percent sulfur, preferably at least 0.25 weight percent sulfur, such as hydrocarbon feeds containing at least 10 weight percent hydrocarbons having an atmospheric pressure boiling point above 600° F., preferably hydrocarbon feeds containing at least 30 weight percent hydrocarbons having an atmospheric pressure boiling point above 900° F. The process is designed to treat hydrocarbon feeds containing up to 1,000 weight ppm total metal content (nickel, vanadium iron, etc.) without pretreatment. When the total metallic content exceeds 1,000 weight ppm, it may be necessary to employ a conventional metals removal step or to use a guard chamber. By way of example, suitable hydrocarbon oils include whole petroleum crude oils, topped or reduced petroleum crude oils; heavy petroleum distillates, such as vacuum gas oil, coker gas oil, and visbreaker oil; petroleum atmospheric residua; petroleum vacuum residua; deasphalted residua; the asphaltene fraction from deasphalting operations; bottoms of catalytic cracking process fractionators; cycle oils, such as catalytically cracked cycle oils; pitch, asphalt and bitumen derived from coal, tar sands or shales; naturally occurring tars as well as tars resulting from petroleum refining processes; shale oil; tar sand oil and mixtures thereof.

In desulfurization zone 29, the hydrocarbon oil feed contacts the steam and hydrogen containing gas in the presence of a hydrodesulfurization catalyst contained in fixed bed 31. Instead of maintaining the catalyst in the fixed bed, the catalyst could be maintained in a moving, fluid or ebullient bed.

The catalyst in bed 31 may be any conventional hydrodesulfurization catalyst. Generally, the hydrodesulfurization catalyst comprises a metallic hydrogenation component and a refractory support. Suitable metallic components having hydrogenation activities are those selected from the group generally consisting of Groups VIB and VIII of the Periodic Table of Elements. The Periodic Table referred to herein is in accordance with the *Handbook of Chemistry and Physics,* published by the Chemicals Rubber Company, Cleveland, Ohio, 45th Edition (1964). Suitable supports include alumina phosphate, boron phosphate, refractory inorganic oxides, such as alumina, silica, silica-alumina, zirconia, magnesia, titania, boria, strontia, hafnia and mixtures thereof. The preferred refractory oxide is an alumina-containing carrier comprising from about 1 to about 6 weight percent silica. Such catalytic supports which additionally comprise a hydrogenation component may be prepared as indicated in U.S. Pat. No. 3,509,044, the teachings of which are hereby incorporated herein by reference. A preferred catalyst comprises a molybdenum component, a cobalt or nickel component composited with a silica-alumina support. The desulfurization reaction zone is operated at hydrodesulfurization conditions including a temperature varying from about 400° F. to about 900° F., preferably from about 650° to about 850° F., a total pressure varying from about 800 psig to about 3,000 psig. The hydrocarbon oil feed passes through the catalyst at a liquid hourly space velocity (defined as volumes of hydrocarbon charge per hour per volume of catalyst disposed in the reaction zone) of from about 0.1 to about 15, preferably from about 0.2 to 7.5. The hydrogen partial pressure in the desulfurization reaction zone would generally range from about 200 to about 2500 psig, preferably from about 500 to about 2000 psig. The steam partial pressure in the desulfurization zone will generally range from about 50 to about 300 psig, preferably from about 100 to about 250 psig. Suitable hydrogen feed rates will generally range from about 1,000 to about 30,000 standard cubic feet of hydrogen per barrel of hydrocarbon feed, preferably from about 1,250 to about 10,000. The effluent of desulfurization zone 29 flows into separator 35 via line 33. The liquid effluent from separator 35 recovered via line 37 is a hydrocarbon product having a lower sulfur content than the oil feed. Unused hydrogen, gaseous hydrocarbons and hydrogen sulfide are removed from separator 35 via line 39. If desired, the hydrogen mixture may be recycled to the desulfurization vessel after removal of excessive hydrogen sulfide by conventional means.

What is claimed is:

1. In a process for hydrodesulfurizing a sulfur-containing heavy hydrocarbon oil wherein said oil is contacted with hydrogen and steam in the presence of a hydrodesulfurization catalyst at hydrodesulfurization conditions including a temperature varying from about 400° F. to about 900° F. and a pressure varying from about 800 psig to about 3000 psig, the improvement which comprises:

(a) introducing a hydrogen-containing gas into a circulating water stream to produce a mixed stream;

(b) heating said mixed stream to a temperature below about 450° F. to vaporize a portion of said water and to produce a steam and hydrogen-containing gas;

(c) separating the steam and hydrogen-containing gas from the unvaporized water;

(d) contacting said steam and hydrogen-containing gas with a sulfur-containing heavy hydrocarbon oil in the presence of said hydrodesulfurization catalyst under said hydrodesulfurization conditions; and (e) recovering a hydrocarbon oil reduced in sulfur content.

2. The process of claim 1, wherein said vaporization is effected at a temperature ranging from about 300° F. to about 400° F.

3. The process of claim 1, wherein said hydrodesulfurization process is conducted at a liquid hourly space velocity varying from about 0.1 to 15 volumes of said oil per hour per volume of said catalyst.

4. The process of claim 1, wherein said heavy hydrocarbon oil is a gas oil.

5. The process of claim 1, wherein said heavy hydrocarbon oil is a petroleum residuum.

6. The process of claim 1, wherein said steam and hydrogen-containing gas comprises from about 5 to about 15 mole percent steam.

7. The process of claim 1, wherein said mixed stream is heated in step (b) by passing said stream through a heat exchanger.

* * * * *